US007768362B2

(12) United States Patent
Eom et al.

(10) Patent No.: US 7,768,362 B2
(45) Date of Patent: Aug. 3, 2010

(54) COMB POLARIZER SUITABLE FOR MILLIMETER BAND APPLICATIONS

(75) Inventors: Soon-Young Eom, Daejon (KR); Je-Hoon Yun, Daejon (KR); Soon-Ik Jeon, Daejon (KR); Chang-Joo Kim, Daejon (KR); Yury Borlsovich Korchemkin, Moscow (RU)

(73) Assignee: Electronics and Telecommunications Research Institute, Daejon (KR)

( * ) Notice: Subject to any disclaimer, the term of this patent is extended or adjusted under 35 U.S.C. 154(b) by 0 days.

(21) Appl. No.: 11/834,876

(22) Filed: Aug. 7, 2007

(65) Prior Publication Data

US 2008/0117005 A1 May 22, 2008

(30) Foreign Application Priority Data

Nov. 17, 2006 (KR) ..... 10-2006-0114041

(51) Int. Cl.
*H01P 1/16* (2006.01)

(52) U.S. Cl. ..... 333/21 A; 333/157

(58) Field of Classification Search ..... 333/21 A, 333/157, 34

See application file for complete search history.

(56) References Cited

U.S. PATENT DOCUMENTS 4,100,514 A 7/1978 DiTullio et al.
4,922,213 A * 5/1990 Ghosh ..... 333/21 A
5,576,668 A * 11/1996 Clark et al. ..... 333/21 A
7,009,464 B1 * 3/2006 Patel ..... 333/21 A
2002/0125968 A1 * 9/2002 Yoneda et al. ..... 333/21 A
2002/0171597 A1 * 11/2002 Krishmar-Junker et al. . 343/786

FOREIGN PATENT DOCUMENTS

JP 59-200501 11/1984
KR 1020050120556 A 12/2005

OTHER PUBLICATIONS

Eom, S. Y. et al, "A New Comb Circular Polarizer Suitable for Millimeter-Band Application," *ETRI Journal,* 28(5):656-659 (Oct. 2006).

Tucholke, U. et al., "Field Theory Design of Square Waveguide Iris Polarizers," *IEEE Transactions on Microwave Theory and Techniques,* MIT-34(1):156-160 (Jan. 1986).

Yoneda, N. et al., "A Design of Novel Grooved Circular Waveguide Polarizers," *IEEE Transactions on Microwave Theory and Techniques,* 48(12):2446-2452 (Dec. 2000).

* cited by examiner

*Primary Examiner*—Benny Lee
*Assistant Examiner*—Gerald Stevens

(57) ABSTRACT

There is provided a comb polarizer suitable for millimeter band applications including: a waveguide having an aperture side formed of two separable half waveguides, and a comb shaped conductive unit having a plurality of cogs interposed between two half waveguides for transforming a linear polarized signal to a circular polarized signal.

14 Claims, 5 Drawing Sheets

COMB POLARIZER SUITABLE FOR MILLIMETER BAND APPLICATIONS

TECHNICAL FIELD

The present invention relates to a comb polarizer suitable for millimeter band applications; and, more particularly, to a millimeter band comb polarizer having a comparative simple structure allowing an easy manufacturing process, less manufacturing and testing cost, and applicable for other bands, by embodying a polarizer transforming a linear polarization to a circular polarization with a comb shaped conductive plate (comb conductive plate) interposed between two half waveguides.

BACKGROUND ART

Conventionally, satellite communication frequency bands, an L-band, a C-band, and a Ku-band, were used to provide a wideband satellite multimedia service. Due to the restricted frequency bandwidth of the satellite communication frequency, the satellite frequency band has been replaced with a millimeter band for the satellite communication to provide a wideband multimedia service. The millimeter wave is an electromagnetic wave having a frequency in a range from about 30 to 300 GHz. That is, the millimeter wave denotes an electromagnetic wave having a millimeter wavelength.

The present invention relates to a circular polarizer having a new structure. The circular polarizer is one of major parts used for a satellite communication antenna power-feed system. The circular polarizer transforms a linear polarization to a left circular polarization or a right circular polarization.

Various conventional methods were introduced to embody a conventional circular polarizer. For example, according to a first conventional method, a circular polarizer is embodied by inserting a conductive iris structure in a rectangular or circular waveguide. According to a second conventional method, a circular polarizer is embodied by inserting conductive poles in a rectangular or circular waveguide. In a third conventional method, a circular polarizer is embodied by inserting a dielectric plate in a rectangular or circular waveguide. In a fourth conventional method, a circular polarizer is embodied by inserting a rectangular groove formed on an outer surface of a circular waveguide.

Since the conventional circular polarizers have complicated structures as described above, it is very difficult to manufacture the conventional circular polarizer for millimeter band applications. The complicated manufacturing process of the conventional circular polarizer is the major factor to increase the manufacturing cost and the testing cost. Particularly, the conventional circular polarizer having the dielectric plate has shortcomings. The conventional circular polarizer having the dielectric plate has the electric characteristic varying according to peripheral temperature characteristic, and cannot be used for dual band application.

DISCLOSURE

Technical Problem

An embodiment of the present invention is directed to providing a comb polarizer, suitable for millimeter band applications, having a comparative simple structure allowing an easy manufacturing process, a less manufacturing and testing cost, and applicable for other bands, by embodying a polarizer transforming a linear polarization to a circular polarization with a comb shaped conductive plate (comb conductive plate) interposed between two half waveguides.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided a comb polarizer suitable for millimeter band applications including: a waveguide having an aperture side formed of two separable half waveguides, and a comb shaped conductive unit having a plurality of cogs interposed between two half waveguides for transforming a linear polarized signal to a circular polarized signal.

Advantageous Effects

According to the present invention, a circular polarizer is embodied by interposing a com conductive plate between two half circular waveguides using a conventional circular waveguide as it is. Therefore, the circular polarizer according to the present embodiment has a simple structure that allows an easy manufacturing process, less manufacturing and testing cost, and applicable for other bands.

The simple structure of the circular polarizer according to the present invention can significantly reduce the manufacturing cost and the testing cost although the circular polarizer is manufactured for millimeter band applications that require a complicated and fine manufacturing process and test.

The circular polarizer according to the present embodiment can be used as a single and a dual band circular polarizer for various applications including the conventional satellite or mobile communication antenna system. Due to such an advantage, it may give great economical benefit to the related field.

Although the circular polarizer according to the present embodiment includes no tuning elements for controlling performance, the electric performance thereof can be optimized by controlling the size of the comb cog. Also, it can be used for single or dual band design according to needs.

BEST MODE FOR THE INVENTION

The advantages, features and aspects of the invention will become apparent from the following description of the embodiments with reference to the accompanying drawings, which is set forth hereinafter.

Figure 1:
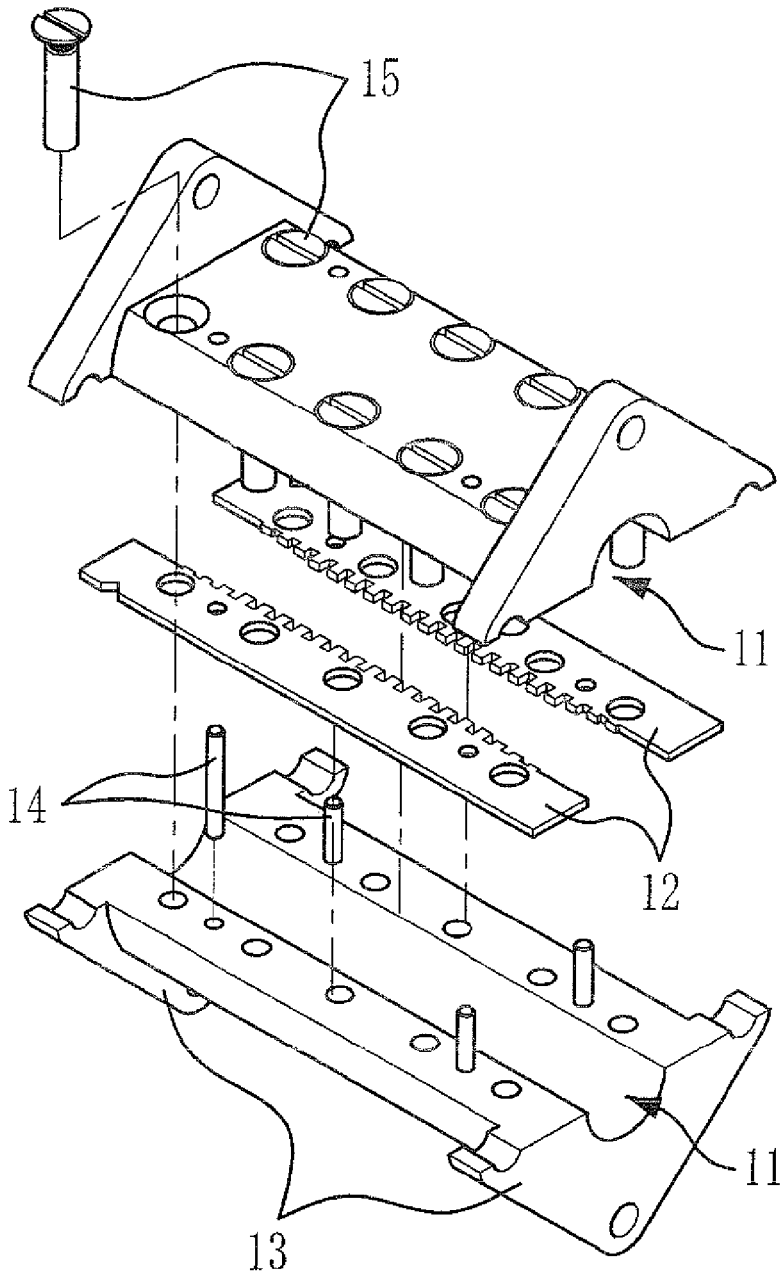
FIG. 1 is a diagram illustrating a comb circular polarizer suitable for millimeter band applications according to an embodiment of the present invention.

FIG. 1 is a diagram illustrating a comb circular polarizer suitable for millimeter band applications according to an embodiment of the present invention.

As shown in FIG. 1, the comb circular polarizer according to the present embodiment includes a comb conductive unit includes two comb conductive plates 12 interposed between a pair of half circular waveguides 11. However, the present invention is not limited thereto. That is, a comb conductive plate can be interposed between two square waveguides. Also, it is not necessary to insert two conductive plates. The comb circular polarizer according to the present embodiment can be embodied by inserting one conductive plate.

The comb circular polarizer according to the present embodiment also includes input and output flanges 13 of a circular polarizer used to connect to other circular waveguide type parts, fixing pins 14 for fixing two conductive plates 12 at a predetermined position, and screws 15 for fastening two half circular waveguides and two comb conductive plates.

Figure 3:
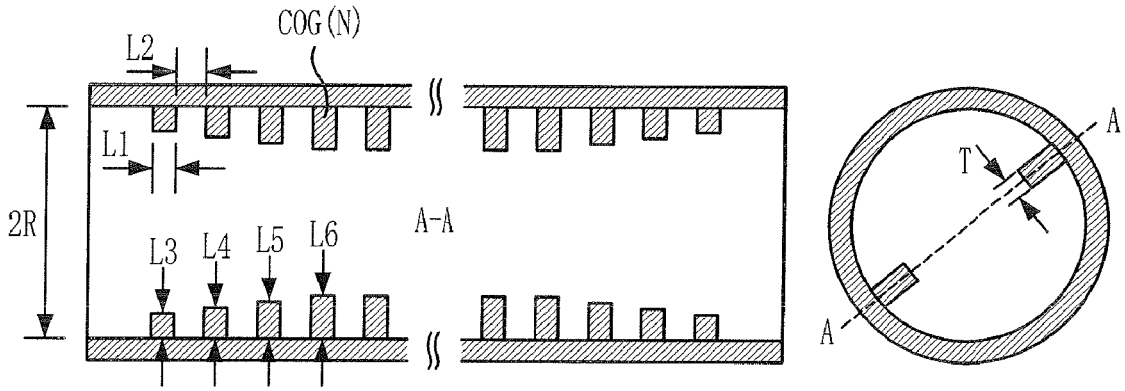
FIG. 3 is a diagram illustrating an internal sectional view of the comb circular polarizer shown in FIG. 1 and designing sizes thereof.

Each of the comb conductive plates 12 has a symmetric shape in a longitudinal axis and an abscissa axis and includes comb cogs regularly formed, as shown in FIG. 3. A pair of comb cogs can be equivalently modeled as a parallel inductor and a capacitor. Those elements induce phase delay effect.

That is, a linear polarized signal, which enters to a plane formed by a pair of the conductive plates 12 inserted between the circular waveguides 11 at an offset of about +45° or −45°, includes vertical component and horizontal component to the comb conductive plate plane in a vector. The vertical component propagates without passing through the comb structure. On the contrary, the horizontal component propagates passing through the comb structure. As a result, the phase delay is induced. In order to induce circular polarization, the differential phase shift between the vertical and horizontal components of the input signal must be +90° at an operating band. Therefore, the number of comb cogs and the size of each comb cog must be optimized for making the required differential phase shift.

Figure 2:
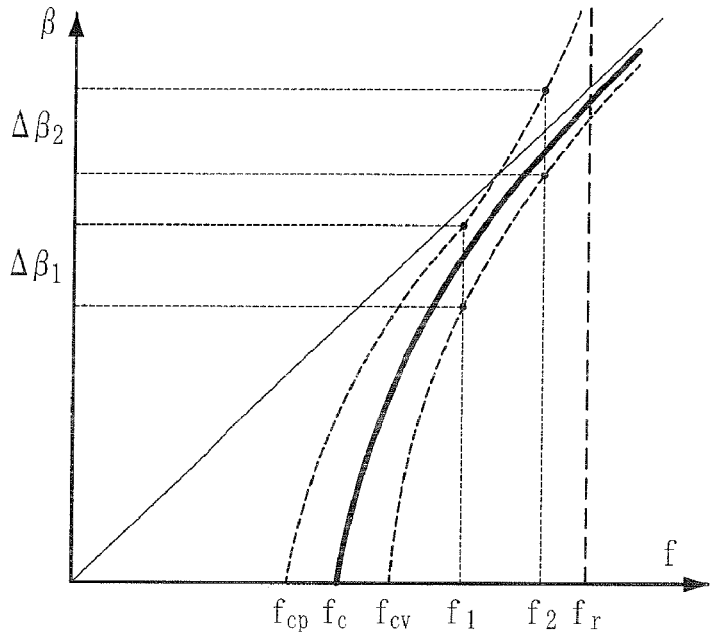
FIG. 2 is a graph illustrating a conceptual correlation between a propagation constant and a frequency.

FIG. 2 is a graph illustrating a conceptual correlation between a propagation constant (β) and a frequency (f). That is, FIG. 2 conceptually shows the fundamental concept of operating a comb structured circular polarizer in a dual band according to an embodiment of the present invention.

As shown in FIG. 2, the cut-off frequency ($f_c$) of the circular waveguide 11 is greater than the cut-off frequency ($f_{cp}$) of a horizontal input signal that horizontally enters to the comb conductive plate. The cut-off frequency ($f_c$) of the circular waveguide 11 is smaller than the cut-off frequency of a vertical input signal that vertically enters to the comb conductive plate.

Also, the propagation constant becomes converged as the frequency of the vertical input signal increase like as the propagation constant variation in a circular waveguide. On the contrary, the horizontal input signal becomes diffused because the resonant frequency induced from the comb structure restricts the horizontal input signal.

In order to drive the comb circular polarizer for dual band as shown in FIG. 2, two frequencies $f_1$ and $f_2$ must have a relatively differential phase shift Δφ of +90° as shown in Eq. 1.

$$\Delta\phi=\Delta\beta 1\cdot L=\Delta\beta 2\cdot L=90° \quad \text{Eq. 1}$$

In Eq. 1, $\Delta\beta=(\beta_{pi}-\beta_{vi})$ where i=1,2. Δβ denotes a relative propagation constant, and $\beta_{pi}$ and $\beta_{vi}$ denote the propagation constants of the horizontal input signal and the vertical input signal, respectively. i is each of the operating frequencies, L denotes the length of a comb cog delaying a phase, $f_{cv}$ and $f_{cp}$ denotes cut-off frequencies of the vertical and horizontal input signals, and $f_c$ and $f_r$ denote cut-off frequency of a circular waveguide and resonant frequencies induced from the comb cog structure. $f_1$ and $f_2$ denote denotes dual operating frequencies.

FIG. 3 is a diagram illustrating an internal sectional view of the comb circular polarizer shown in FIG. 1 and designing sizes thereof.

The designing parameters, a radius R of a circular waveguide, the number N of comb cogs, a thickness T, a length L1, a gap L2 between combs, and heights L3 to L6, are optimally decided according to an operating frequency. Particularly, the comb cogs disposed at the input/output end of the comb conductive plate are tapered to gradually increase to the center thereof so as to have the same height L6 of the cogs disposed at the center for impedance matching of the input/output signals. In order to match the input/output impedances, the heights of cogs gradually increase from the input/output ends to the center within a predetermined region only, for example, from the input/output ends to L3 to L6. The heights of cogs in other regions are same.

The electrical performance of the comb circular polarizer is decided by the designing parameters. Particularly, the radius R of the circular waveguide must be decided not to propagate high-order modes such as TM11, TE31, TM21, and TE12 modes. Since the second-order modes such as TM01, TE21, and TE01 modes are attenuated by the symmetric structure of the comb structure, they do not influence to decide the diameter of the circular waveguide. Therefore, the operating frequency range of the circular waveguide is decided by a resonant frequency induced based on the radius R of the circular waveguide and the comb structure like as Eq. 2.

$$\frac{\lambda_{1,max}}{K_1} < R < \frac{\lambda_{2,max}}{K_2} \quad \text{Eq. 2}$$

In Eq. 2, R is a radius of a circular waveguide, $K_1$ and $K_2$ are parameters related to TE11 and TM11 modes. For example, $K_1$=3.413, and $K_2$=1.640. For example, when a radius (R) is 5.335 mmm, the operating frequency band must be in a range from about 16.5 GHz<f<34.3 GHz.

As an example, the results of simulations of using a dual band satellite communication circular polarizer using a comb circular polarizer according to an embodiment of the present invention will be described hereinafter. The dual band frequency reflected to design is about 20.355 to 21.155 GHz (Band 1, K_band) and 30.085~30.885 GHz (Band 2, Ka_band).

In order to optimally design the comb circular polarizer, a CST Microwave Studio™, a commercial designing simulator, is used. Table 1 shows the optimal designing parameter of the comb circular polarizer having a differential phase shift of 90°±5° in the given dual bands.

TABLE 1

| Designing parameter | Designing value |
|---|---|
| N | 20 |
| R | 5.335 mm |
| T | 0.9 mm |
| L1 | 1.4 mm |
| L2 | 1.0 mm |
| L3 | 0.30 mm |
| L4 | 0.60 mm |
| L5 | 0.90 mm |
| L6 | 1.23 mm |

Figure 4:
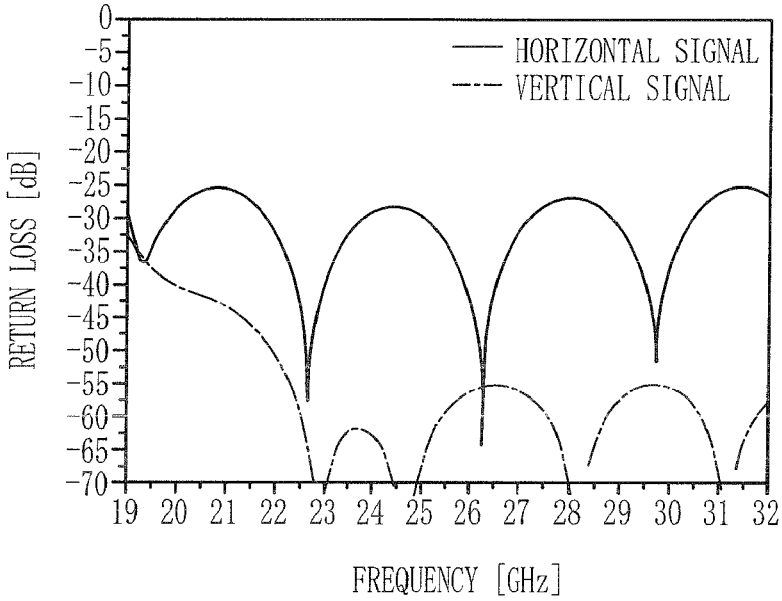
FIG. 4 is a graph illustrating a simulation result for return loss characteristic of a dual band comb circular polarizer according to an embodiment of the present invention.
Figure 5:
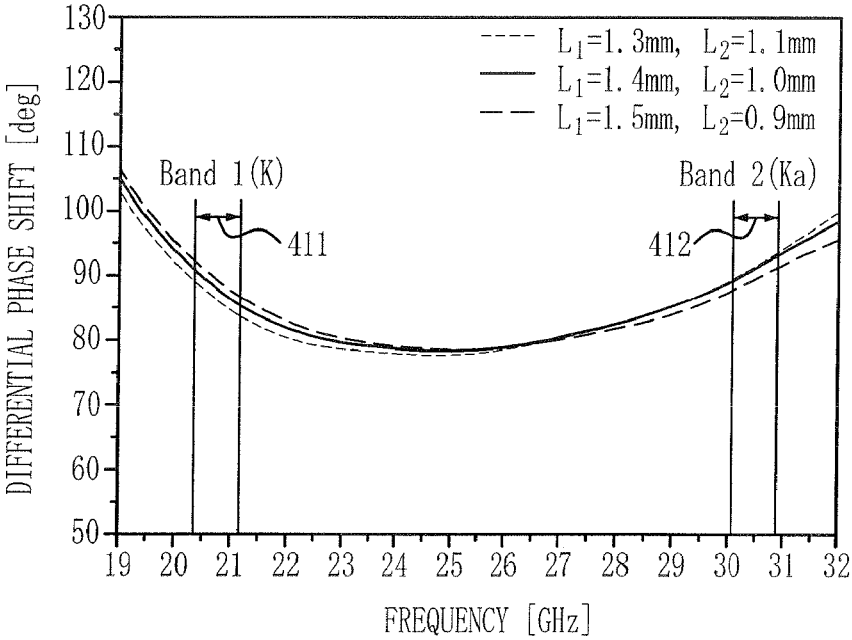
FIG. 5 is a graph illustrating a simulation result for a comparatively differential phase shift characteristic of a dual band comb circular polarizer according to an embodiment of the present invention.

FIG. 4 is a graph illustrating a simulation result for return loss characteristic of a dual band comb circular polarizer according to an embodiment of the present invention, and FIG. 5 is a graph illustrating a simulation result for a relatively differential phase shift characteristic of a dual band comb circular polarizer according to an embodiment of the present invention.

In the FIG. 4, a curve 401 denotes the return loss of a signal entering horizontally to the comb conductive plate, and a curve 402 denotes the return loss of the return loss of a signal entering vertically to the comb conductive plate. As shown in the curves 401 and 402, the dual band comb circular polarizer according to the present embodiment has superior return loss characteristics because the return loss less than −25 dB is shown at an operating frequency band for each signal.

The graph of FIG. 5 shows relatively differential phase shift characteristic curves have characteristics varying according to the variation of the longitudinal lengths of the comb cogs when the sum (L1+L2) of the length L1 of the comb cog and the gap L2 between the comb cogs is 2.4 mm. The first band (K-band) 411 is used as a satellite communication receiving band, and the second band (Ka-band) 412 is used as a satellite communication transmitting band. Since the transmission polarization characteristics are strictly limited, the second band (Ka-band) is more optimized than the first band (K-band) 411.

Figure 6:
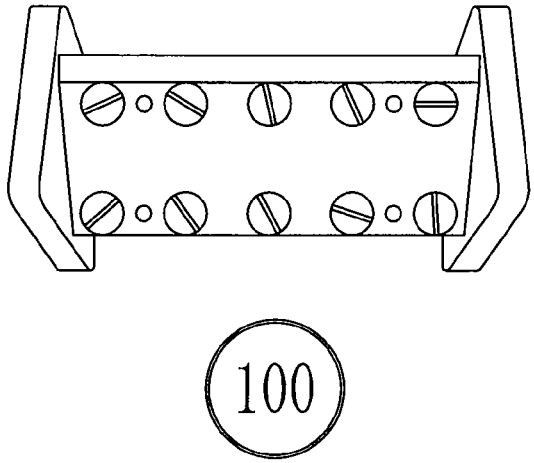
FIG. 6 is a picture of a prototype of a comb circular polarizer according to an embodiment of the present invention.

FIG. 6 is a picture of a prototype of a comb circular polarizer according to an embodiment of the present invention.

As shown in FIG. 6, the prototype circular polarizer is coated with gold for guaranteeing electrical performance and preventing corrosion. The entire length of the dual band circular polarizer is about 60 mm including the length of the input/output flange of 3.5 mm.

Figure 7:
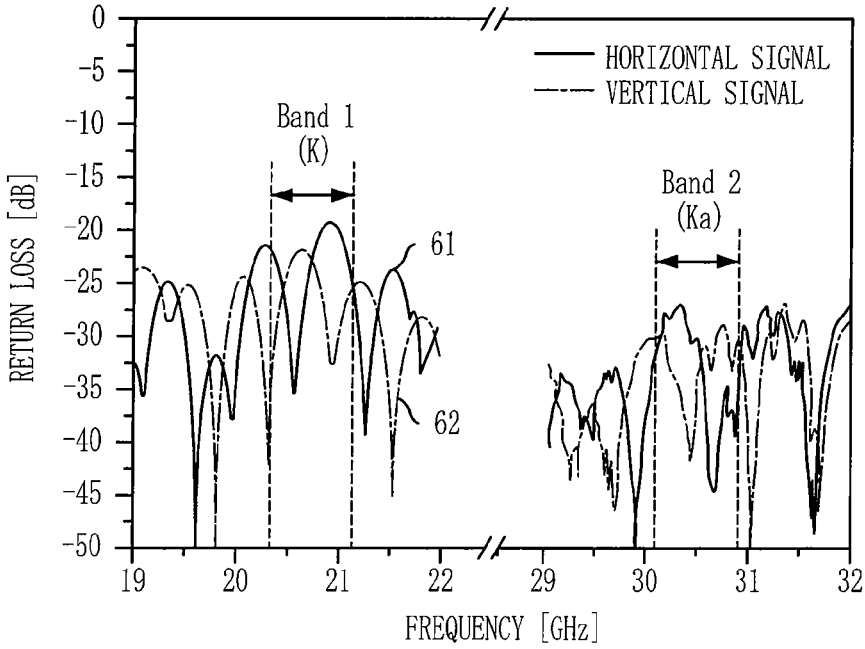
FIG. 7 is a graph illustrating an actual measurement result for a reflect loss characteristic of a dual band comb circular polarizer according to an embodiment of the present invention.

FIG. 7 is a graph illustrating an actual result of measuring a return loss characteristic of a dual band comb circular polarizer according to an embodiment of the present invention.

As shown, spherical and circular waveguide adaptors have superior return loss characteristics of less than −30 dB, and the measurement result includes the return loss characteristics of the spherical and circular waveguide adaptors.

In the graph of FIG. 7, a solid curve 61 denotes a measuring result of a horizontal signal at a comb conductive plate and a dotted curve 62 denotes a measuring result of a vertical signal at a comb conductive plate. As shown in the measuring result, the dual band comb circular polarizer according to the present embodiment has superior impedance matching characteristics of less than −26.4 dB in the second band (Ka-band) and about −18.8 dB in the first band (K-band) although numerous ripple characteristics are shown due to the test waveguide adaptors.

Figure 8:
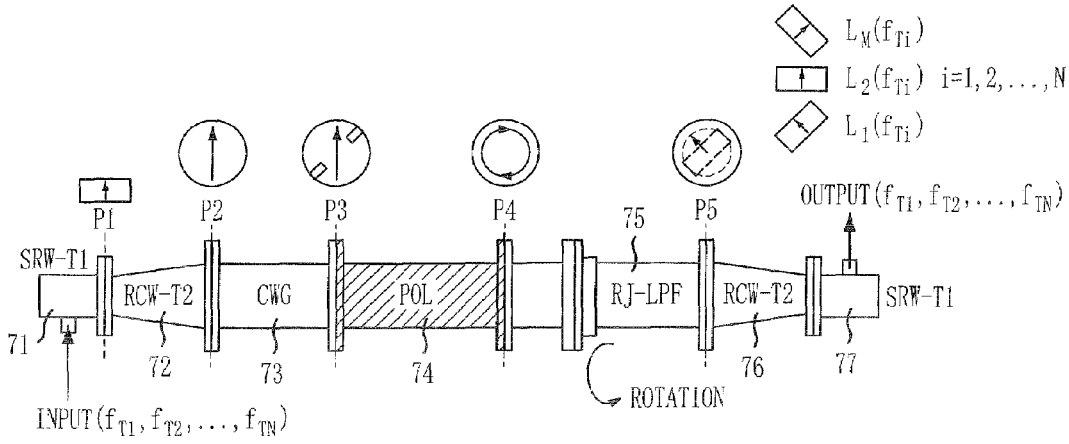
FIG. 8 is a diagram illustrating a structure of a testing equipment for measuring cross polarization characteristic according to a rotation detection method.

FIG. 8 is a diagram illustrating a structure of a testing device for measuring cross polarization characteristic according to a rotation detection method.

The relative phase different characteristics of the comb circular polarizer according to the present embodiment can be replaced with the cross polarization characteristics. In order to measure the cross polarization characteristics, a rotation detection method can be used as shown in FIG. 8.

The test device using the rotation detection method, as shown in FIG. 8, includes two SMA (or K) connector—circular waveguide transformers (SRW-T1) 77 and 77, two spherical-waveguide transformers (RCW-T2) 72 and 76, one circular waveguide (CWG) 73, a prototype comb circular polarizer (POL) 74, one rotary joint, and a linear polarization filter (RJ-LPF) 75. In FIG. 8, 'P1' denotes a boundary between the SRW-T1 71 and the RCW-T2, 'P2' denotes a boundary between the RCT-T2 72 and the CWG 73, and 'P3' denotes a boundary of the CWG 73 and the POL 74, and 'P4' denotes a boundary between the RJ-LPF 75 and the POL 74. 'P5' denotes a boundary between the RJ-LPF 75 and the RCW-T2 76.

If N test frequencies $f_{T1}, f_{T2}, \ldots, f_{TN}$ input to the input SMA (or K) connector—spherical waveguide transformer (SRW-T1) 71, a vertical basic mode signal is generated at the P1 boundary. Then, the liner signal passes through the spherical-circular waveguide transformer (RCW-T2) 72 and is transformed to a vertical basic mode signal in the circular waveguide at the P2 boundary side.

The vertical basic mode signal passes through the circular waveguide (CWG) 73 and enters to the comb structure of the prototype circular waveguide (POL) 74 at 45° inclined. Then, the linear polarized signal passes through the comb circular polarizer POL 74 and then, the circular polarization signal is generated at the P4 boundary.

The rotary joint and linear polarized filter (RJ-LPF) 75 detects linear polarized signals from the generated circular polarized signal at various rotation angles. In FIG. 8, L1 ($f_{Ti}$), L2 ($f_{Ti}$), . . . , LM ($f_{Ti}$) denote levels detected from the test frequency $f_{Ti}$ at each rotation angle. Such levels are detected from all test frequencies ($f_{T1}, f_{T2}, \ldots, f_{TN}$).

The difference $\Delta A_{dB}$ between the maximum value and the minimum value in the measuring results of each test frequency denotes an axial ratio characteristic like as Eq. 3.

$$\Delta A_{dB}=\max[L_1(f_{Ti}):L_M(f_{Ti})]-\min[L_1(f_{Ti}):L_M(f_{Ti})],\ i=1, 2, \ldots, N. \quad \text{Eq. 3}$$

In Eq. 3, $\max[L_1(f_{Ti}):L_M(f_{Ti})]$ denotes M levels detected at the output end. That is, it is the maximum value selected from $L_1(f_{Ti})$, $L_2(f_{Ti})$, . . . $L_M(f_{Ti})$. $\min[L_1(f_{Ti}):L_M(f_{Ti})]$ denotes a minimum value. i denotes N testing frequencies. The axial ratio characteristics may be transited to a cross polarization level using Eq. 4.

$$Lcross = 10\cdot\log\left(\frac{1-K}{1+K}\right)^2 \text{ [dB]} \quad \text{Eq. 3}$$

In Eq. 4, K is given as $$10^{-\frac{\Delta A_{dB}}{20}}.$$

Figure 9:
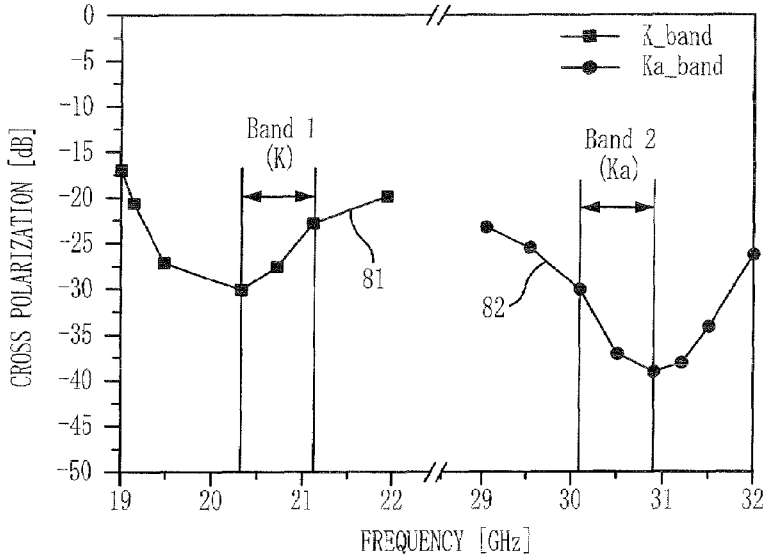
FIG. 9 is a graph illustrating a cross polarization characteristic of a dual band comb circular polarizer, measured by the testing equipment shown in FIG. 8.

FIG. 9 is a graph illustrating a cross polarization characteristic of a dual band comb circular polarizer, measured by the testing equipment shown in FIG. 8.

As shown in the measuring result of FIG. 9, the dual band comb circular polarizer according to the present embodiment has superior cross polarization characteristics of less than −30.0 dB in the second band (Ka-band).

The present application contains subject matter related to Korean patent application No. 2006-0114041, filed in the Korean Intellectual Property Office on Nov. 17, 2006, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A comb polarizer suitable for millimeter band applications comprising:

a waveguide having two separable half waveguides, the two half waveguides defining an aperture of a predefined shape when the two half waveguides are placed together; and a comb-shaped conductive unit having a plurality of cogs interposed between the two half waveguides for transforming a linear polarized signal to a circular polarized signal, the comb-shaped conductive unit having a thickness along a first direction and a width along a second direction that is orthogonal to the first direction, wherein the thickness of the comb-shaped conductive unit is substantially smaller than the width thereof, so that the aperture defined by the two half waveguides remains substantially the same when the comb-shaped conductive unit is interposed between the half waveguides.

2. The comb polarizer of claim 1, wherein the comb-shaped conductive unit is a comb conductive plate inserted between two junction sides of the two half waveguides.

3. The comb polarizer of claim 1, wherein the comb-shaped conductive unit includes two comb conductive plates each of which is inserted into two junction sides contacting the two half waveguides, and the cogs of the two comb conductive plate are symmetrically disposed along a central axis of the waveguide.

4. The comb polarizer of claim 2, wherein the comb conductive plate includes the cogs having heights gradually increased within a predetermined length range in a direction to a center.

5. The comb polarizer of claim 4, wherein the waveguide is a square waveguide.

6. The comb polarizer of claim 4, wherein the waveguide is a circular waveguide.

7. The comb polarizer of claim 6, wherein an operating frequency is decided according to a radius of the circular waveguide and a cog structure of the comb conductive plate.

8. The comb polarizer of claim 4, further comprising an input and output flange for connecting to other waveguide parts.

9. The comb polarizer of claim 8, wherein the comb conductive plate is fastened between the two half waveguides through a fastening member.

10. The comb polarizer of claim 1, wherein the aperture defined by the two half waveguides is shaped like a circle when the comb-shaped conductive unit is interposed between the half waveguides.

11. A comb polarizer suitable for millimeter band applications comprising:

a waveguide having two separable half waveguides, the two half waveguides defining an aperture of a predefined shape when the two half waveguides are placed together; and a comb-shaped conductive unit having a plurality of cogs interposed between the two half waveguides for transforming a linear polarized signal to a circular polarized signal, the comb-shaped conductive unit having a thickness along a first direction and a width along a second direction that is orthogonal to the first direction, wherein the thickness of the comb-shaped conductive unit is substantially smaller than the width thereof, so that the aperture defined by the two half waveguides remains substantially the same when the comb-shaped conductive unit is interposed between the half waveguides, wherein the comb-shaped conductive unit is a comb conductive plate inserted at a junction side between two junction sides contacting the two half waveguides, wherein the comb conductive plate includes the cogs having heights gradually increased within a predetermined length range in a direction to a center, wherein the waveguide is a circular waveguide, wherein an operating frequency is decided according to a radius of the circular waveguide and a cog structure of the comb conductive plate, and wherein an operating frequency range of the comb polarizer is decided by:

$$\frac{\lambda_{1,max}}{K_1} < R < \frac{\lambda_{2,min}}{K_2},$$

wherein, R denotes a radius of the circular waveguide, $K_1$ and $K_2$ are parameters related to TE11 and TM11 modes, respectively, where $K_1$=3.413 and $K_2$=1.640, wherein $\lambda_{1,max}$ and $\lambda_{2,min}$ denote wavelengths at each operating band.

12. The comb polarizer of claim 11, wherein the comb polarizer makes a phase difference between a horizontal component and a vertical component of an input linear polarized signal to be 90°.

13. A comb polarizer suitable for millimeter band applications comprising:

a waveguide having an aperture side formed of two separable half waveguides; and a comb-shaped conductive unit having a plurality of cogs interposed between the two half waveguides for transforming a linear polarized signal to a circular polarized signal, wherein the comb-shaped conductive unit is a comb conductive plate inserted at a junction side between two junction sides contacting the two half waveguides, wherein the comb conductive plate includes the cogs having heights gradually increased within a predetermined length range in a direction to a center, wherein the waveguide is a circular waveguide, wherein an operating frequency is decided according to a radius of the circular waveguide and a cog structure of the comb conductive plate, wherein an operating frequency range of the comb polarizer is decided by:

$$\frac{\lambda_{1,max}}{K_1} < R < \frac{\lambda_{2,min}}{K_2},$$

wherein, R denotes a radius of the circular waveguide, $K_1$ and $K_2$ are parameters related to TE11 and TM11 modes, respectively, where $K_1$=3.413 and $K_2$=1.640.

14. The comb polarizer of claim 13, wherein the comb polarizer makes a phase difference between a horizontal component and a vertical component of an input linear polarized signal to be 90°.

* * * * *